US011982136B2

(12) United States Patent
Leung et al.

(10) Patent No.: US 11,982,136 B2
(45) Date of Patent: May 14, 2024

(54) HELICAL BLADE STABILIZER WITH LINE-OF-SIGHT FACES

(71) Applicant: Halliburton Energy Services, Inc., Houston, TX (US)

(72) Inventors: Philip Park-Hung Leung, Edmonton (CA); Michael John Strachan, Crossville, TN (US); John Kenneth Snyder, Shenandoah, TX (US); Vinodh Kumar Palani, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 42 days.

(21) Appl. No.: 17/727,602

(22) Filed: Apr. 22, 2022

(65) Prior Publication Data

US 2022/0356769 A1 Nov. 10, 2022

Related U.S. Application Data

(60) Provisional application No. 63/186,729, filed on May 10, 2021.

(51) Int. Cl.
*E21B 17/10* (2006.01)
*E21B 17/22* (2006.01)

(52) U.S. Cl.
CPC ..... *E21B 17/1078* (2013.01); *E21B 17/10* (2013.01); *E21B 17/22* (2013.01)

(58) Field of Classification Search
CPC ..... E21B 17/1078; E21B 17/10; E21B 17/22
See application file for complete search history.

(56) References Cited

U.S. PATENT DOCUMENTS 6,435,275 B1 8/2002 Kirk et al.
9,151,118 B2 * 10/2015 Robson ..... E21B 10/62
(Continued)

FOREIGN PATENT DOCUMENTS

CA 1154430 9/1983
CN 109555488 4/2019
(Continued)

OTHER PUBLICATIONS

Pastusek, Paul E. ( ). [Society of Petroleum Engineers IADC/SPE Drilling Conference and Exhibition—Fort Worth, Texas, USA (Mar. 6, 2018)] IADC/SPE Drilling Conference and Exhibition—Stabilizer Selection Based on Physics and Lessons Learned.
(Continued)

*Primary Examiner* — Yong-Suk (Philip) Ro
(74) *Attorney, Agent, or Firm* — Benjamin Ford; C. Tumey Law Group PLLC

(57) ABSTRACT

A stabilizer for use in a wellbore may include a downhole tubular configured to couple to a downhole conveyance in a wellbore, as well as two or more helical blades extending radially outward from the downhole tubular. The two or more helical blades are oriented about the downhole tubular to form respective flow paths between adjacent blades. Further, each blade of the two or more helical blades may include a line-of-sight face and a gauge ramp. The line-of-sight face is formed adjacent a leading inner blade wall of the blade at a lower end of the blade and is angularly offset from the leading inner blade wall. The gauge ramp extends from an outer surface of the downhole tubular toward an outer blade surface of the blade proximate the lower end of the blade.

20 Claims, 5 Drawing Sheets

(56) References Cited

U.S. PATENT DOCUMENTS

| | | | | |
|---|---|---|---|---|
| D983,231 | S * | 4/2023 | Hansen | D15/21 |
| 2009/0260802 | A1 | 10/2009 | Ernst et al. | |
| 2017/0356253 | A1* | 12/2017 | Bailey | E21B 17/042 |
| 2019/0078399 | A1 | 3/2019 | Smith et al. | |
| 2019/0169937 | A1 | 6/2019 | Vazquez et al. | |
| 2019/0301250 | A1* | 10/2019 | Schlappy | E21B 19/24 |

FOREIGN PATENT DOCUMENTS

| | | |
|---|---|---|
| EP | 1030957 | 8/2004 |
| EP | 1650400 | 4/2006 |
| WO | 2018151718 | 8/2018 |
| WO | 2019-195411 | 10/2019 |

OTHER PUBLICATIONS

Schlumberger, Integral blade Stabilizer, Available at https://www.slb.com/drilling/bottomhole-assemblies/reamers-and-stabilizers/integral-blade-stabilizer. Accessed Apr. 1, 2022.

International Search Report and Written Opinion for Application No. PCT/US2022/026759, dated Jul. 12, 2022.

* cited by examiner

HELICAL BLADE STABILIZER WITH LINE-OF-SIGHT FACES

CROSS-REFERENCE TO RELATED APPLICATIONS

The present application is a non-provisional conversion of U.S. Provisional Application Ser. No. 63/186,729, filed May 10, 2021, which is herein incorporated by reference in its entirety.

BACKGROUND

In downhole drilling operations, wellbores are drilled into subterranean formations for the recovery of hydrocarbons. As a drill bit moves drills through the formation to form the wellbore, a drill string connecting the drill bit to the surface may contact the walls of the wellbore. Friction resulting from such contact may lead to vibration, stick-slip, and/or whirl of the drill string. As such, straight blade and/or spiral blade stabilizers may be used to reduce these effects by helping to centralize the drill string within the wellbore. Spiral blade stabilizers may be generally more effective than straight blade stabilizers at reducing vibrations and stresses in the drill string as they provide support along a greater portion of the circumference of the drill string (e.g., wrap angle). Unfortunately, spiral blade stabilizers are more likely to cause pressure losses in the wellbore such that cuttings may become trapped in the channels formed between the blades of the stabilizers. Pressure losses in the wellbore, stick-slip, and whirl of the drill string may hinder downhole drilling operations.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are helical blade stabilizers having helical blades configured to reduce pressure losses, as well as stick slip and whirl of the drill string during drilling operations. The helical blades may include line-of-sight (e.g., cutout) faces configured to improve flow paths (e.g., flow areas) formed between the blades of the stabilizers while maintaining a high wrap angle to provide support along a greater portion of the circumference of the drill string. As set forth below the line-of-sight faces are positioned at leading and trailing ends of each helical blade. In some embodiments, the line-of-sight faces may provide for a line-of-sight through the flow paths along an axial direction of the stabilizer. Accordingly, having the line-of-sight faces may reduce pressure losses, as well as stick slip and whirl of the drill string during drilling operations. Further, the helical blades may include blade ramps (e.g., gauge ramps) at the downhole and uphole ends of each helical blade. The blade ramps may be configured to reduce an axial force needed to overcome friction and slide the stabilizer downhole during drilling operations. Accordingly, helical blades configured to reduce pressure losses, as well as stick slip and whirl of the drill string during drilling operations.

Figure 1:
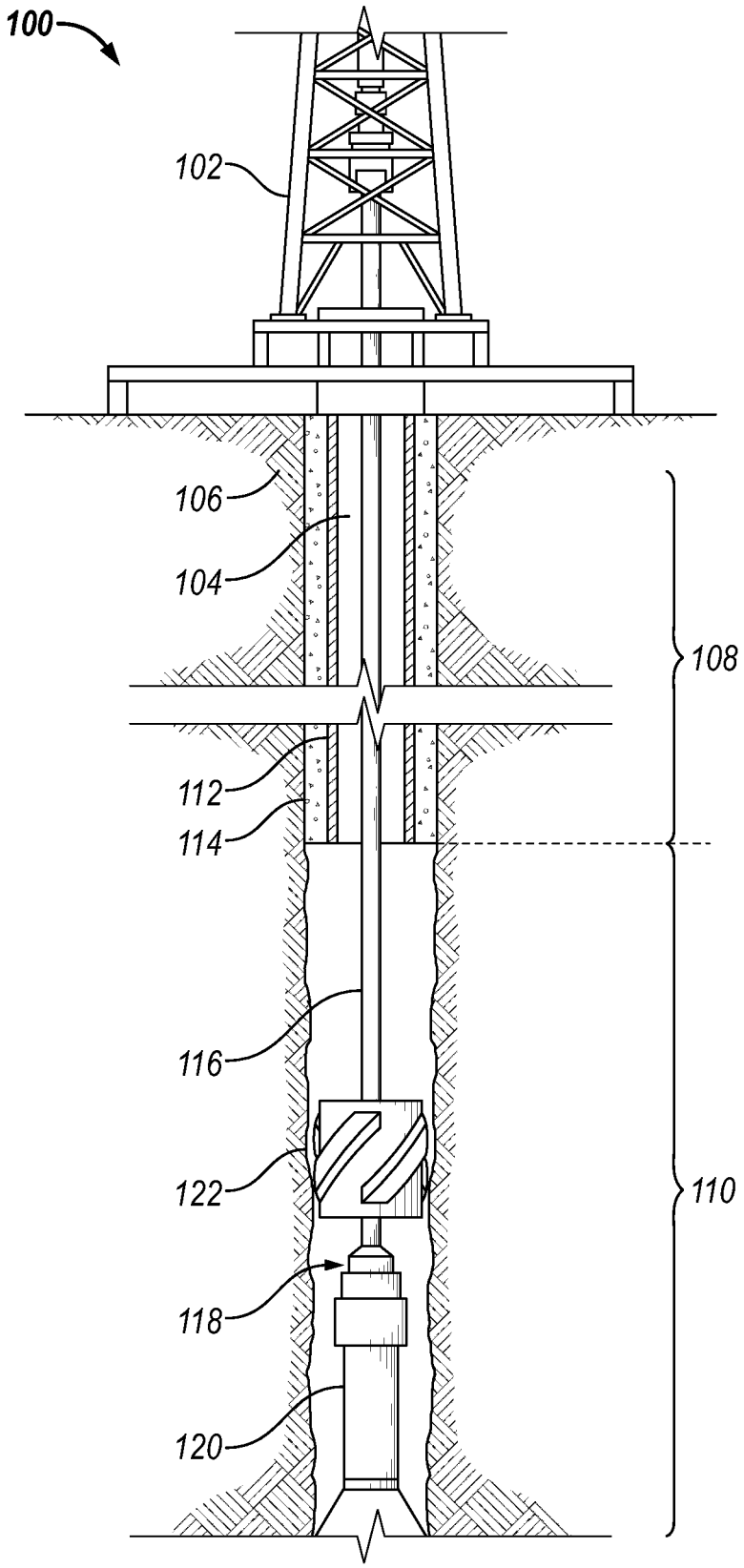
FIG. 1 illustrates a well system including an exemplary operating environment where the apparatuses, systems, and methods, disclosed herein may be employed, in accordance with some embodiments of the present disclosure.

FIG. 1 illustrates a well system 100 including an exemplary operating environment where the apparatuses, systems, and methods disclosed herein may be employed. For example, the well system 100 could use a stabilizer 122 according to any of the embodiments, aspects, applications, variations, designs, etc. disclosed in the following paragraphs. As illustrated, the well system 100 includes a rig 102 extending over and around a wellbore 104 formed in a subterranean formation 106. As those skilled in the art appreciate, the wellbore 104 may be fully cased, partially cased, or an open hole wellbore. In the illustrated embodiment, the wellbore 104 is partially cased, and thus includes a cased region 108 and an open hole region 110. The cased region 108, as is depicted, may employ casing 112 that is held into place by cement 114.

The well system 100 additionally includes a downhole conveyance 116 deploying a downhole tool assembly 118 within the wellbore 104. The downhole conveyance 116 may be, for example, tubing-conveyed, wireline, slickline, drill pipe, production tubing, work string, or any other suitable means for conveying the downhole tool assembly 118 into the wellbore 104. In one embodiment, the downhole conveyance 116 may include American Petroleum Institute "API" pipe.

Moreover, as illustrated, the downhole tool assembly 118 includes a downhole tool 120 and a stabilizer 122 (e.g., a helical blade stabilizer). The downhole tool 120 may comprise any downhole tool that could be positioned within a wellbore. Certain downhole tools 120 that may find particular use in the well system 100 include, without limitation, drilling and logging tools, rotary steerable tools, instrumented logging systems, MLWD tools, mud motors and drill string stabilizers (e.g., collars with stabilizer blades), drill bits, bottom hole assemblies (BHAs), sealing packers, elastomeric sealing packers, non-elastomeric sealing packers (e.g., including plastics such as PEEK, metal packers such as inflatable metal packers, as well as other related packers), liners, an entire lower completion, one or more tubing strings, one or more screens, one or more production sleeves, or some combination thereof.

Figure 2B:
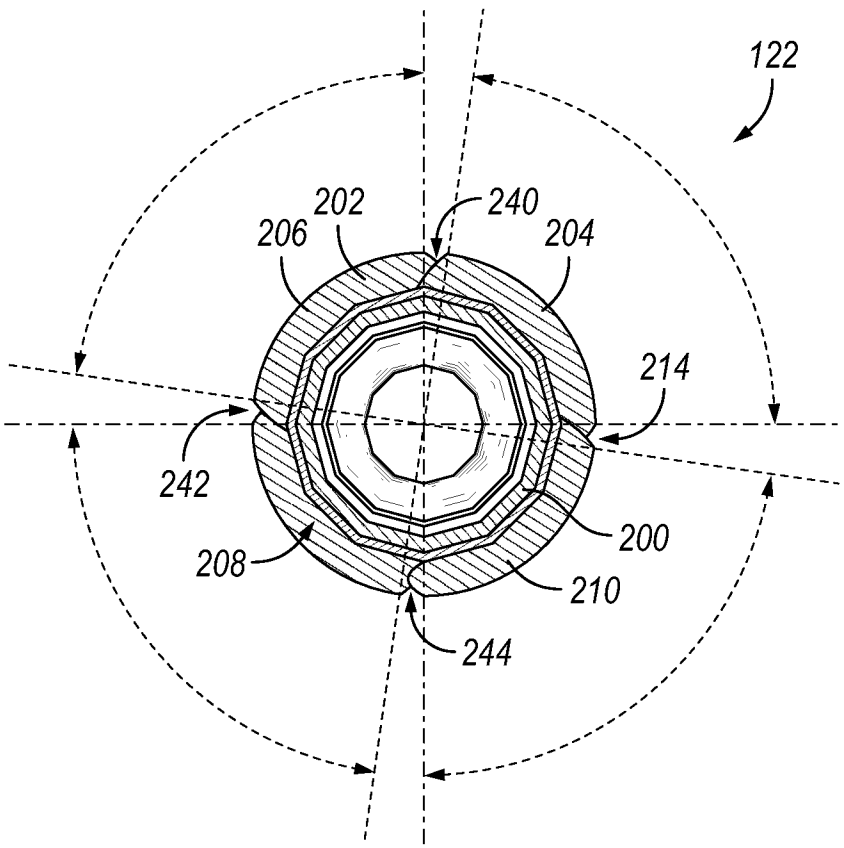
FIGS. 2A and 2B illustrate a side view and a cross-sectional view, respectively, of a helical blade stabilizer with line-of-sight faces, in accordance with some embodiments of the present disclosure.
Figure 2A:
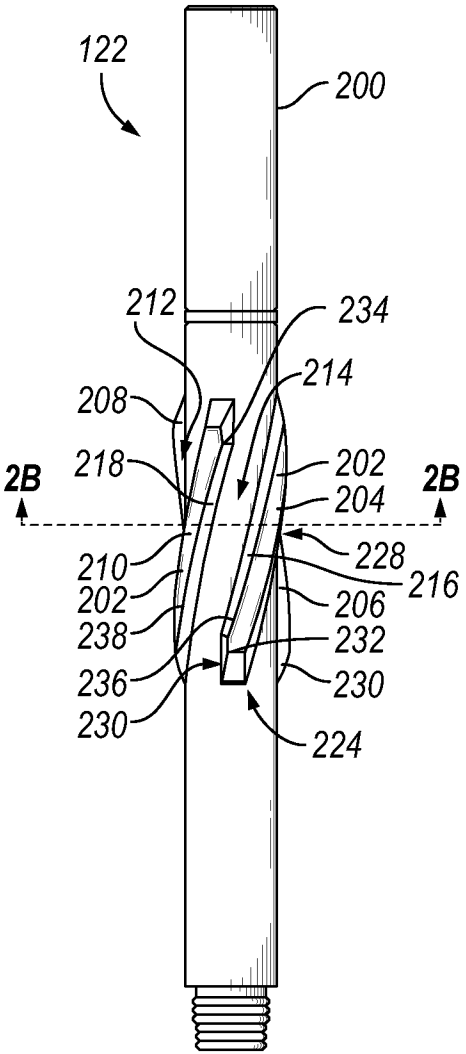

FIGS. 2A and 2B illustrate a side view and a cross-sectional view, respectively, of a helical blade stabilizer with line-of-sight faces, in accordance with some embodiments of the present disclosure. Referring to FIG. 2A, the stabilizer 122, in accordance with one embodiment of the disclosure, includes a downhole tubular 200 couplable to the downhole conveyance 116 (shown in FIG. 1). Further, the stabilizer 122 includes two or more helical wellbore stabilizing elements (e.g., helical blades 202) extending radially outward from the downhole tubular 200. In some embodiments, the stabilizer 122 may have two, three, four, or more helical blades 202. In the illustrated embodiment, the stabilizer 122 includes four helical blades 202 (e.g., a first blade 204, a second blade 206, a third blade 208, and a fourth blade 210) that each extend radially outward from the downhole tubular 200.

The two or more helical blades 202 may be oriented about the downhole tubular 200 to form respective flow paths 212 between adjacent blades of the two or more blades 202. For example, a first flow path 214 of the respective flow paths 212 may be formed between a leading face 216 of the first blade 204 and a trailing face 218 of the fourth blade 210. In some embodiments, at least a portion of each of the respective flow paths 212 may have a direct axial flow path between the adjacent blades 202 along a blade length of the two or more helical blades 202. Further, the respective flow paths 212 formed between leading faces 216 and trailing faces 218 of adjacent blades 202 may have variable widths along the blade length of the two or more helical blades 202. For example, a lower width of the first flow path 214 proximate a downhole end 224 (e.g., lower end) of the first blade 204 may be larger than a middle width of the first flow path 214 proximate a middle portion 228 of the first blade 204. Having variable widths of the flow paths 212 along the blade length may reduce pressure losses during drilling operations.

Moreover, having spiral or helical blades 202 may reduce drill string vibrations and stresses, as compared to straight blades, by reducing an amount of a circumference of the downhole tubular 200 that is unsupported by the two or more helical blades 202. Specifically, straight blades are unsupported at the respective flow paths 212 formed between the adjacent straight blades as the blades do not wrap around the downhole tubular 200 to even partially support the downhole tubular 200 at the respective flow paths 212. Gaps in support about the circumference of the stabilizer 122 may lead to vibrations and stresses. Thus, as illustrated, the two or more helical blades 202 are wrapped about the downhole tubular 200 to at least partially support the stabilizer 122 at the respective flow paths 212; thereby, supporting about a larger percentage of the circumference of the stabilizer 122 than a straight blade stabilizer. However, helical blade stabilizers 122 generally increase pressure losses in the annulus, which may create other issues as a threshold pressure in the wellbore 104 may be required to move cuttings away from the two or more helical blades 202. As such, pressure losses may trap cuttings, resulting in increased erosion of a drill string (e.g., the downhole conveyance 116) and the stabilizer 122. Accordingly, the present stabilizer 122 comprises at least one line-of-sight (LOS) face 230 to reduce pressure losses in the annulus while maintaining high wrap angle (e.g., discussed in FIG. 2B) to provide support about the circumference of the stabilizer 122.

The wrap angle is the total angular extent of full blade diameter, summed across all blades 202 of the stabilizer 122. The wrap angle is calculated by summing, for all blades 202, the angular distances (e.g., in degrees) between a leading downhole corner 232 of a blade and a trailing uphole corner 234 of the blade 202. The leading downhole corner 232 may be a full-blade diameter portion of the blade 202 positioned furthest downhole at a leading edge 236 of the blade 202. Similarly, the trailing uphole corner 234 may be a full-blade diameter portion of the blade positioned furthest uphole at a trailing edge 238 of the blade 202. The leading downhole corner 232 and the trailing uphole corner 234 may not be positioned at a tapered portion of the blade as tapered portions are not full-blade diameter portions of the blade.

FIG. 2B illustrates a cross-sectional view of the helical blade stabilizer 122 having the plurality of line-of-sight faces 230 such that the stabilizer 122 may have a high wrap angle without generating excessive pressure loss in the wellbore. As illustrated, the two or more helical blades 202 may be oriented about the downhole tubular 200 to form a wrap angle between 350-360 degrees. For example, the first blade 204 may wrap circumferentially about the downhole tubular 200 from 0-88 degrees. That is, the leading downhole corner 232 of the first blade 204 may be positioned at zero degrees and the trailing uphole corner 234 of the first blade 204 may be positioned at eighty-eight degrees. Further, the second blade 206 may wrap circumferentially about the stabilizer 122 from 90-178 degrees, the third blade 208 may wrap circumferentially about the stabilizer 122 from 180-268 degrees, and the fourth blade 210 may wrap circumferentially about the stabilizer 122 from 270-358 degrees, such that the two or more helical blades 202 may form a wrap angle of 352 degrees. Accordingly, each respective flow path 212 (e.g., the first flow path 214, a second flow path 240, a third flow path 242, and a fourth flow path 244) in this example has two degrees of clear line of sight along the longitudinal direction of the downhole tubular 200.

Figure 3:
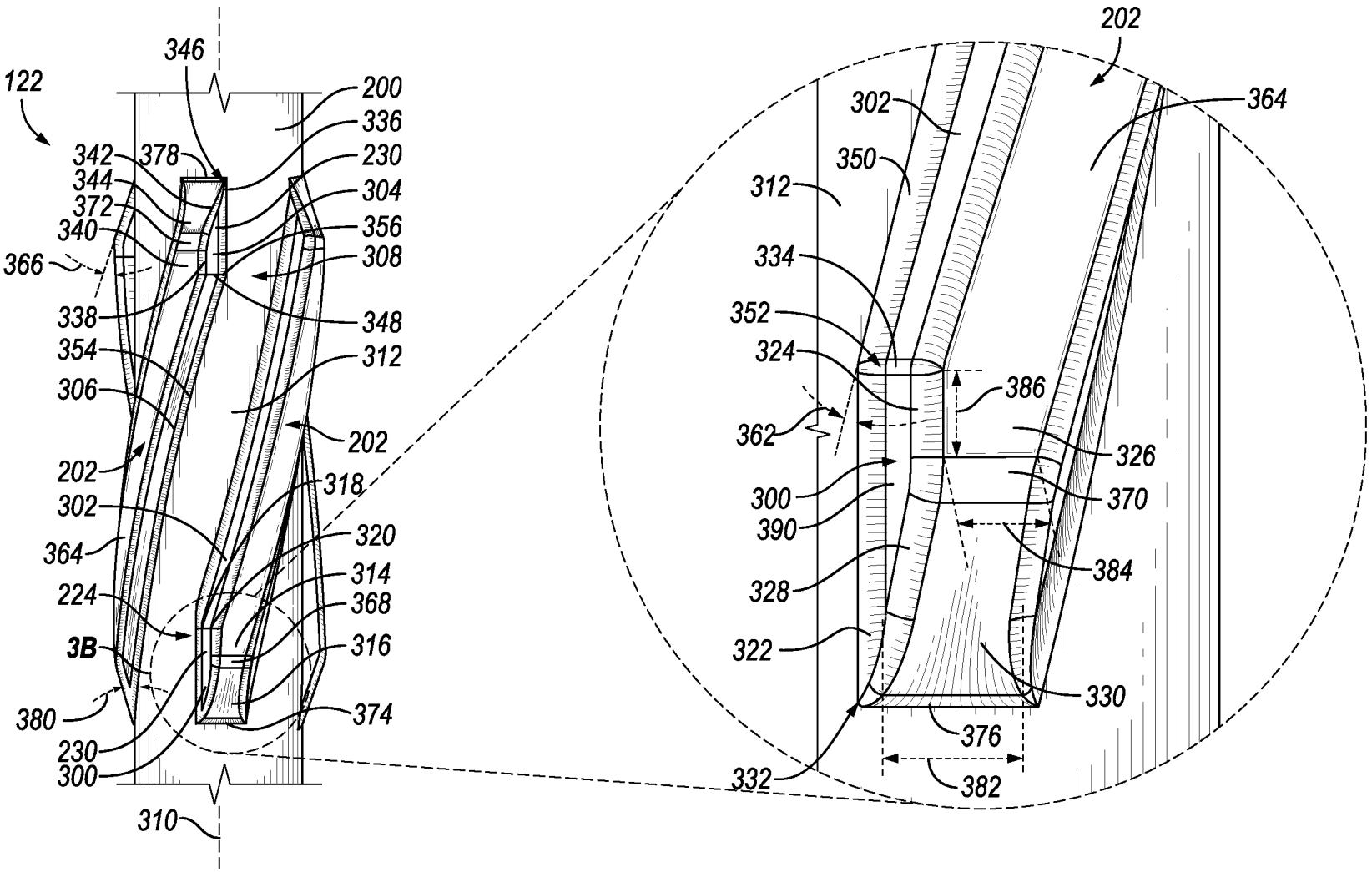
FIG. 3 illustrates a detailed view of a helical blade stabilizer comprising helical blades with respective line-of-sight faces, in accordance with some embodiments of the present disclosure.

FIG. 3 illustrates a detailed view of a helical blade stabilizer 122 comprising helical blades with respective line-of-sight faces 230, in accordance with some embodiments of the present disclosure.

As illustrated, each blade of the two or more helical blades 202 may comprise a lower line-of-sight (LOS) face 300 formed adjacent a leading inner blade wall 302 of the blade 202 at the lower (e.g., downhole) end 224 of the blade 202. Further, each blade of the two or more helical blades 202 may comprise an upper line-of-sight face 304 formed adjacent a trailing inner blade wall 306 of the blade at an upper (e.g., uphole) end 308 of the blade. As such, the lower LOS face 300 and the upper LOS face 304 may be formed on opposite sides of the blade 202. Moreover, as illustrated, the line-of-sight faces 230 may be planar (e.g., flat). Further, the line-of-sight faces 230 may be angularly offset from corresponding inner blade walls 302 and 306 such that the line-of-sight faces 230 are more aligned with the longitudinal axis 310 of the downhole tubular than corresponding inner blade walls 302 and 306. As such, the two or more helical blades 202 may form a high wrap angle (e.g., between 350-360 degrees) while still providing a clear line of sight for each respective flow path 212.

As illustrated, the line-of-sight faces 230 each comprise a LOS surface 390 that extends radially outward from an outer surface 312 of the downhole tubular 200 toward a respective gauge surface 314 and gauge ramp 316 of the blade 202. The line-of-sight faces 230 may extend directly outward in the radial direction. However, in some embodiments, the line-of-sight faces 230 may comprise a pitch angle between negative twenty to twenty degrees such that a radially inner portion 318 of the LOS faces 230 may be rotated about the circumference of the downhole tubular 200 with respect to a radially outer portion 320 of the LOS faces 230. Moreover, with respect to the lower LOS face 300, the lower LOS face 300 extends radially outward from a leading inner LOS edge 322 formed at an interface between the lower LOS face 300 and the outer surface 312 of the downhole tubular 200 proximate the leading inner blade wall 302 of the blade 202. A portion of the lower LOS face 300 extends radially outward to a leading outer LOS edge 324 formed at an interface between the lower LOS face 300 and a lower gauge surface 326. Another portion of the lower LOS face 300 extends radially outward to a lower ramp LOS edge 328 formed at an interface between the lower LOS face 300 and the lower gauge ramp 330. In some embodiments, the lower ramp LOS edge 328 may intersect with a lower end 332 of the leading inner LOS edge 322 at the outer surface 312 of the downhole tubular 200. Moreover, the lower LOS face 300 extends upward to a leading blade LOS edge 334 formed at an interface between the lower LOS face 300 and the leading inner blade wall 302 of the blade 202.

Similarly, the upper LOS face extends radially outward from a trailing inner LOS edge 336 formed at an interface between the upper LOS face 304 and the outer surface 312 of the downhole tubular 200 proximate the trailing inner blade wall 306. A portion of the upper LOS face 304 extends radially outward to a trailing outer LOS edge 338 formed at an interface between the upper LOS face 304 and the upper gauge surface 340. Another portion of the upper LOS face 304 extends radially outward to an upper ramp LOS edge 342 formed at an interface between the upper LOS face 304 and the upper gauge ramp 344. In some embodiments, the upper ramp LOS edge 342 may intersect with an upper end 346 of the trailing inner LOS edge 336 at the outer surface 312 of the downhole tubular 200. Moreover, the upper LOS face 304 extends downward to a trailing blade LOS edge 348 formed at an interface between the upper LOS face 304 and the trailing inner blade wall 306 of the blade 202.

As illustrated, the leading inner LOS edge 322 of the lower LOS face 300 may transition to a leading inner blade edge 350 at an upper end of the leading inner LOS edge 352. Similarly, the trailing inner LOS edge 336 of the upper LOS face 304 may transition to a trailing inner blade edge 354 at a lower end of the upper inner LOS edge 356. Moreover, in some embodiments, the inner LOS edges 322, 336 may be aligned parallel to the longitudinal axis 310 of the stabilizer 122. Alternatively, the inner LOS edges 322, 336 may be offset from the longitudinal axis 310 by a LOS helix angle such that the inner LOS edges 322, 336 wrap around a portion of the circumference of the downhole tubular. For example, a lower end of the leading inner LOS edge 322 may be rotated circumferentially about the downhole tubular 200 by a first LOS helix angle between −15.0 and 15.0 degrees. However, the first LOS helix angle may be less than a blade helix angle 362 of the leading inner blade edge 350 such that the leading inner LOS edge 322 of the lower LOS face 300 is oriented more axially downward than the leading inner blade edge 350 with respect to the longitudinal axis of the stabilizer 122. The blade helix angle 362 may be greater than fifteen degrees. In the illustrated embodiment, the first LOS helix angle is about zero degrees and the blade helix angle 362 is about twenty degrees. Moreover, the LOS helix angle may be any suitable angle that maintains an adequate line of sight for the respective flow paths 212 along the longitudinal direction of the stabilizer 122. In another example, the leading inner LOS edge 322 may be anchored at the lower end of the leading inner LOS edge 322 and the upper end of the leading inner LOS edge 352 may be rotated circumferentially by a second LOS helix angle between −15.0 and 15.0 degrees. Moreover, the first LOS helix angle and second LOS helix angle may be between −5.0 and 5.0 degrees, −3.0 and 3.0 degrees, or −1.0 and 1.0 degrees. Moreover, in the illustrated embodiment, the leading inner LOS edge 322 of the lower LOS face 300 is straight between the upper and lower ends of the leading inner LOS edge 322. However, in some embodiments, the leading inner LOS edge 322 may be curved such that the lower LOS face 300 may be curved (e.g., FIG. 6).

Moreover, as set forth above, each blade of the two or more blades 202 may include at least one gauge ramp 316 (e.g., a lower gauge ramp 330, an upper gauge ramp 344) and at least one gauge surface 314 (e.g., a lower gauge surface 326, an upper gauge surface 340). The at least one gauge surface 314 is disposed between the corresponding at least one gauge ramp 316 and an outer blade surface 364 of the blade 202. For example, the lower gauge ramp 330 may be positioned downhole from the lower gauge surface 326 such that the lower gauge surface 326 is disposed between the lower gauge ramp 330 and the outer blade surface 364. Moreover, as illustrated, the at least one gauge surface 314 is coplanar with the outer blade surface 364. However, in some embodiments, the at least one gauge surface 314 may comprise a gauge taper angle 366. The gauge taper angle 366 may be between 25-35 degrees with respect to the outer blade surface 364. Alternatively, the gauge taper angle 366 may be between 0-25 degrees with respect to the outer blade surface 364. In the illustrated embodiment, the gauge taper angle 366 is about zero degrees.

The at least one gauge surface 314 transitions to the at least one gauge ramp 316 at an outer ramp edge 368 (e.g., a lower outer ramp edge 370, an upper outer ramp edge 372). An outer transition radius of the outer ramp edge 368 (e.g., from the at least one gauge ramp 316 to the at least one gauge surface 314) is between 20-60% of the height of the blade. For example, the outer transition radius may be 0.3 inches (0.76 cm) for a blade height of 0.85 inches (2.16 cm), such that the outer transition radius from at least one gauge ramp 316 to the at least one gauge surface 314 is about 35% of the blade height of the blade 202. In another example, the outer transition radius may be 0.06 inches (0.15 cm) for a blade height of 0.25 inches (0.64 cm) such that the outer transition radius from the at least one gauge ramp 316 to the at least one gauge surface 314 is about 24% of the height of the blade 202. Moreover, at an opposite end of the at least gauge ramp 316, the at least one gauge ramp 316 may transition to the outer surface 312 of the downhole tubular 200 at an inner ramp edge 374 (e.g., a lower inner ramp edge 376, an upper inner ramp edge 378). An inner transition radius of the at the inner ramp edge 374 (e.g., from the at least one gauge ramp 316 to the outer surface 312 of the downhole tubular 200) is between 5-50% of the height of the blade. For example, the inner transition radius may be 0.06 inches (0.15 cm) for a blade height of 0.25 inches (0.64 cm) such that the inner transition radius from the at least one gauge ramp 316 to the outer surface 312 of the downhole tubular 200 is about 24% of the blade height of the blade 202.

The at least one gauge ramp 316 may comprise a tapered or curved surface that extends axially from the inner ramp edge 374 to the outer ramp edge 368 proximate the at least one gauge surface 314. As set forth above, each blade comprises at least one gauge ramp 316. For example, in the illustrated embodiment, the first gauge ramp of the first blade 204 extends from the lower inner ramp edge 376 toward the lower outer ramp edge 370 proximate the downhole end 224 of the first blade 204, and the second gauge ramp of the first blade 204 extends from the upper inner ramp edge 378 toward the upper outer ramp edge 372 proximate the upper end 308 of the first blade 204. A ramp taper angle 380 of the at least one gauge ramp 316 may be constant along the at least one gauge ramp 316. The ramp taper angle 380 may be between 25-35 degrees. Alternatively, the ramp taper angle 380 may be between 15-60 degrees. In some embodiments, the ramp taper angle 380 may vary along the at least one gauge ramp 316. For example, a first ramp portion of the at least one gauge ramp 316 disposed proximate the outer surface 312 of the downhole tubular 200 may have a first taper angle (e.g., a 45-degree angle) and a second ramp portion of the at least one gauge ramp 316 disposed proximate the at least one gauge surface 314 may have a second taper angle (e.g., a 30-degree angle). In another embodiment, any combination of a taper or curved surface, either convex or concave, could be used to facilitate the transition from the body radius to the maximum gauge ramp radius. Moreover, the ramp taper angle 380 may vary between the upper gauge ramp 344 and the lower gauge ramp 330.

A ramp width 382 of the at least one gauge ramp 316 may be greater than 1.2 inches (3.05 cm) and less than 3.2 inches (8.13 cm). The ramp width 382 may be scaled based at least in part on an outer diameter of the stabilizer 122 as well as a number of blades 202 on the stabilizer 122. For example, the ramp width 382 may be smaller for a stabilizer having four blades than for another stabilizer having three blades. Further, the ramp width 382 may be smaller for a stabilizer 122 with an 8.25-inch outer diameter than for another stabilizer with a 12.00-inch outer diameter. Generally, the ramp width 382 of the gauge ramp is between 10-27% of the blade diameter of the two or more helical blades 202 (e.g., the outer diameter of the stabilizer). Moreover, in some embodiments, the ramp width 382 may be greater than a minimum contact width 384 of the at least one gauge surface 314. Moreover, the blade height (e.g., a distance that the outer blade surface is offset from the outer surface 312 of the downhole tubular 200 in the radial direction) may be between 0.25-1.0 inches (0.64-2.54 cm). However, in some embodiments, the blade height may be up to 12.0 inches (30.48 cm) or more.

Figure 4:
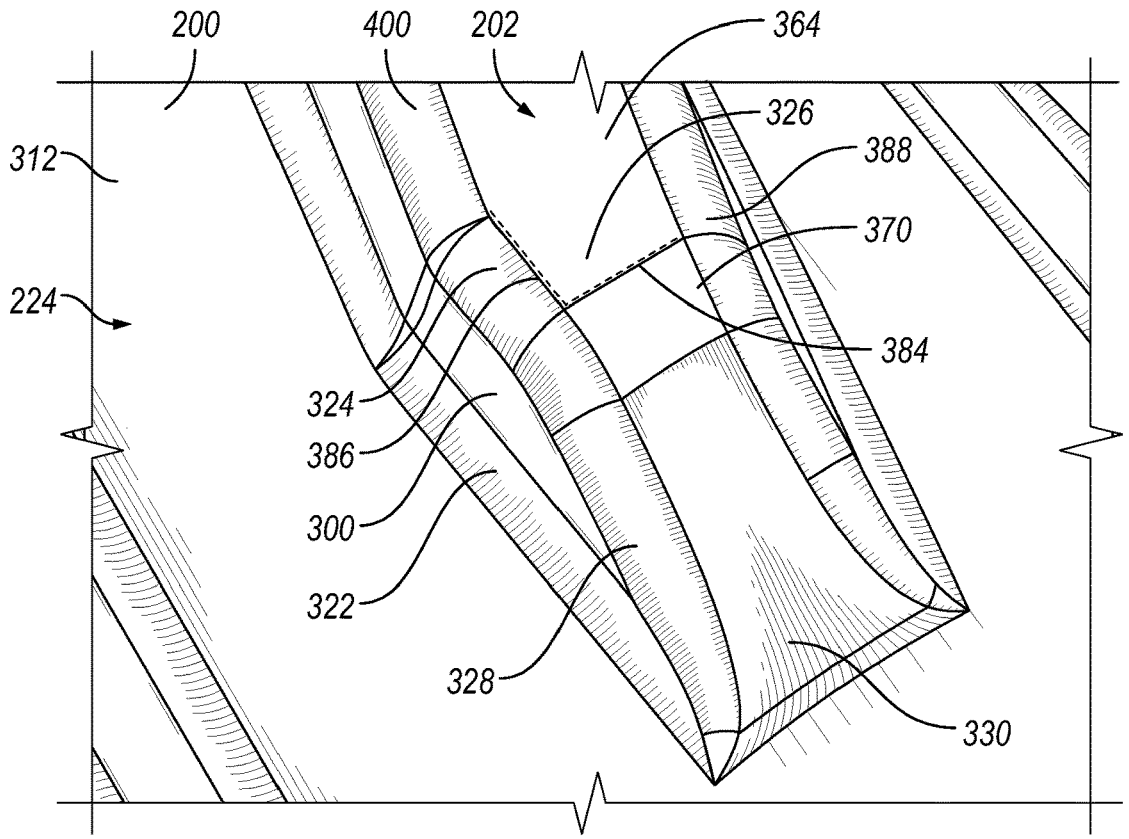
FIG. 4 illustrates a perspective view of a lower end of a helical blade having a line-of-sight face, in accordance with some embodiments of the present disclosure.

FIG. 4 illustrates a perspective view of a lower end of a helical blade having a lower line-of-sight (LOS) face, in accordance with some embodiments of the present disclosure. As set forth above, the lower LOS face 300 may extend radially outward from the outer surface 312 of the downhole tubular 200 toward the lower gauge surface 326 and the lower gauge ramp 330 of the blade 202. Specifically, a portion of the lower LOS face 300 extends radially outward to the leading outer LOS edge 324 formed at the interface between the lower LOS face 300 and the lower gauge surface 326, and another portion of the lower LOS face 300 extends radially outward to the lower ramp LOS edge 328 formed at the interface between the lower LOS face 300 and the lower gauge ramp 330. Although the downhole end 224 of the blade 202 is primarily described herein with respect to FIG. 4, similar features may be included for the upper end of the blade 202.

The leading outer LOS edge 324 and/or the lower ramp LOS edge 328 may comprise a rounded edge surface. The rounded edge surface may comprise a LOS radius between 0.13-0.38 inches (0.33-0.97 cm). In some embodiments, the rounded edge surface may comprise a LOS radius between 0.05-0.75 inches (0.13-1.91 cm). Alternatively, the rounded edge surface may be defined by a radius between 0.25-0.5 inches (0.64-1.27 cm). Further, in some embodiments, the rounded edge surface of the leading outer LOS edge 324 and/or the lower ramp LOS edge 328 may comprise a 20 degree to 50 degree chamfer. However, in some embodiments, the rounded edge surface of the leading outer LOS edge 324 and/or the lower ramp LOS edge 328 may include any suitable splined surface, chamfer, partially arced surface, or non-straight edged surface. The rounded edge surface may reduce vibration, whirl, or other issues that may be caused by the stabilizer during drilling operations. Indeed, the rounded edge surface may reduce occurrences of the stabilizer catching on portions of the wellbore wall. Further, the rounded edge surface may reduce wear to other drilling equipment during handling.

Moreover, the lower gauge surface 326 may comprise a minimum contact length 386 and a minimum contact width 384. The minimum contact length 386 may be defined as a length of the leading outer LOS edge 324 formed at the interface between the lower LOS face 300 and the lower gauge surface 326. The minimum contact length 386 may be between 0.2-1.5 inches (0.51-3.81 cm). Further, the minimum contact width 384 may be defined as a distance between the leading outer LOS edge 324 and an opposite edge 388 of the lower gauge surface 326. The minimum contact width 384 may be measured along the lower outer ramp edge 370. The minimum contact width 384 may be between 0.5-3.0 inches (1.27-7.62 cm). Further, the minimum contact width 384 may be greater than 30% of a blade width of the blade 202. The blade width may be measured at an axially center portion of the blade 202.

Moreover, in contrast to traditional helical wellbore stabilizers having point loads, the leading outer LOS edge 324 may define a longitudinal load line for the leading outer blade edge 400 of the blade 202 during drilling operations. The longitudinal load line may create a distributed load area on the leading outer LOS edge 324. Indeed, a contact pressure on the leading outer blade edge 400 of the blade may be based at least in part on the shape of the leading outer blade edge 400 of the blade. The ranges set forth above for the lower LOS face 300, the lower gauge ramp 330, the lower gauge surface 326, and/or the leading outer LOS edge 324 may be configured to minimize contact pressure on the blade 202 to reduce wear on the stabilizer 122, as well as reduce vibrations, whirl, and/or other issues that may be caused by the stabilizer 122 during drilling operations.

Figure 5:
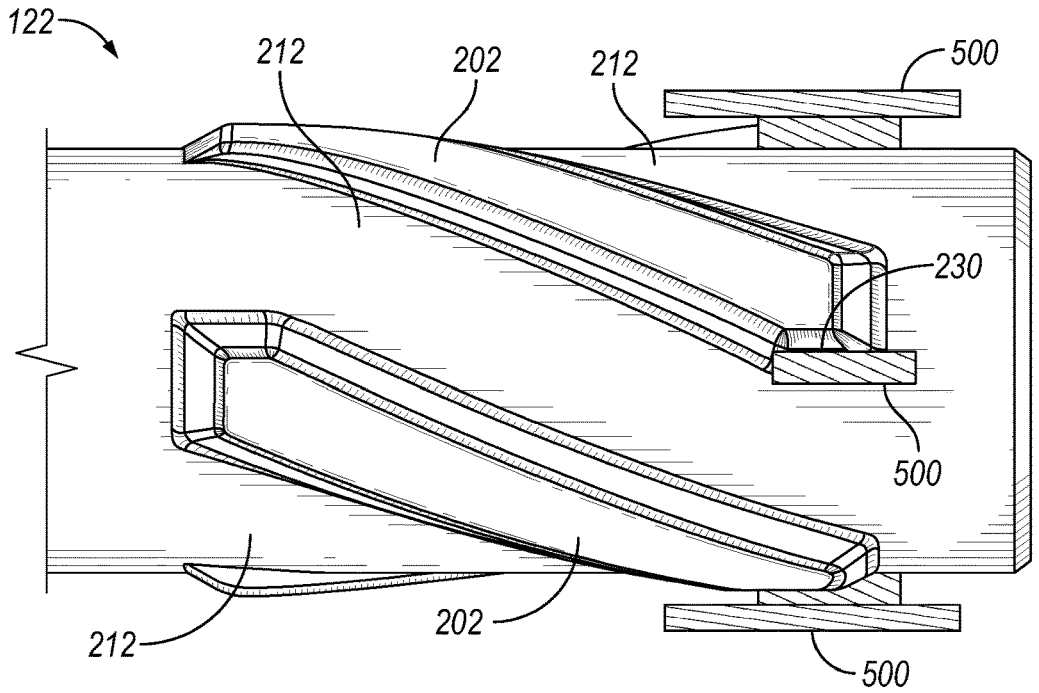
FIG. 5 illustrates a cutaway view of rig tongs engaging the helical blade stabilizer via the line-of-sight faces of the helical blades, in accordance with some embodiments of the present disclosure.

FIG. 5 illustrates a cutaway view of rig tongs 500 engaging the helical blade stabilizer 122 via the line-of-sight faces 230 of the helical blades 202, in accordance with some embodiments of the present disclosure. As set forth above, having helical blades 202 with LOS faces may provide a high wrap angle, as well as flow paths 212 (e.g., unobstructed axial flow paths) between adjacent blades 202 along the length of the helical blades 202. The flow paths 212 may reduce pressure losses such that there is sufficient clearance for flow and cuttings, and the high wrap angle may ensure that the stabilizer 122 provides the drill string (e.g., the downhole conveyance 116) with support in all rotational positions. Additionally, the present stabilizer 122 addresses complications associated with traditional spiral stabilizers. Generally, stabilizers with high wrap angles may be difficult to install and or replace at the rig site as there is not a convenient location for the rig tongs 500 to grasp the spiral stabilizer. The rig tongs 500 may not be used on the stabilizer blades themselves as the blades are typically coated with a hard-wearing material such as coatings consisting of tungsten carbide, polycrystalline diamond compacts (PDC), and/or thermally stable polycrystalline (TSP) diamond, or some combination thereof, and engaging these traditionally spiral blades surfaces with the rig tongs 500 may damage a coating on the blades and/or slip during rotation. However, the present LOS faces 230 may provide a suitable surface for the rig tongs 500 to engage, turn, and torque the stabilizer 122.

Figure 6:
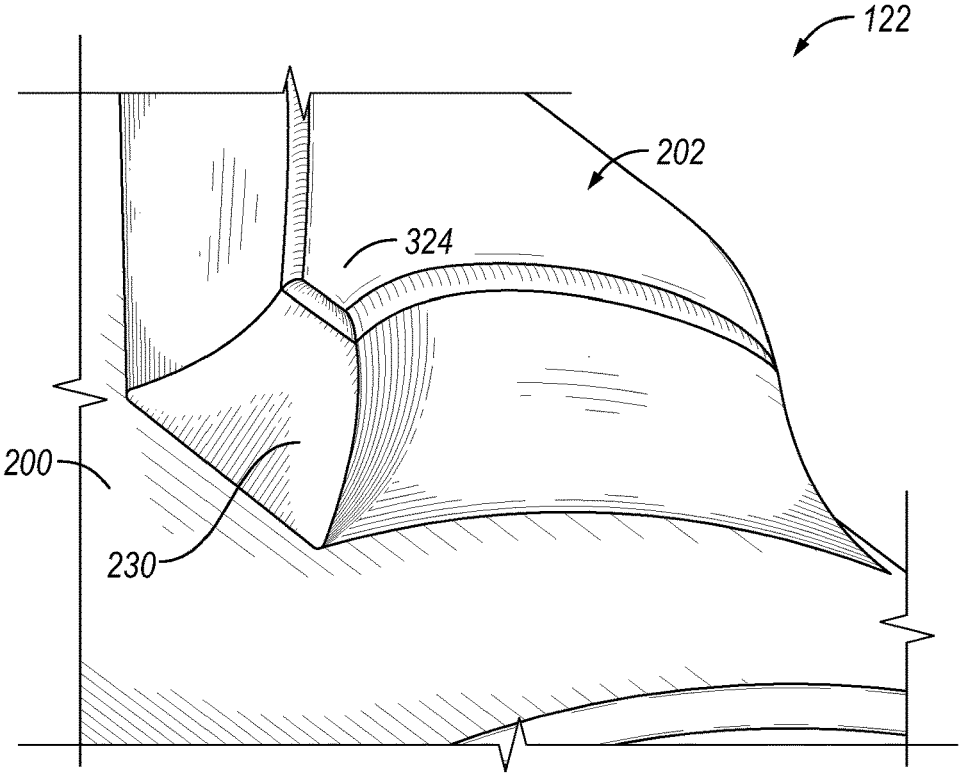
FIG. 6 illustrates a perspective view of a helical blade stabilizer with a radially curved line-of-sight face, in accordance with some embodiments of the present disclosure.

FIG. 6 illustrates a perspective view of a helical blade stabilizer 122 with a radially curved line-of-sight face, in accordance with some embodiments of the present disclosure. As illustrated, the LOS face 230 may comprise a curved profile. In particular, the LOS face 230 may be curved along a radial direction with respect to the downhole tubular 200. In the illustrated embodiment, the curved profile of the lower LOS face 300 is concave. However, in some embodiment, the curved profile may be convex. The curved profile is configured to reduce stress concentrations on the blade and provide for ease of manufacturability. The radius of the curved profile may be dependent on the blade geometry (gauge size, bypass, etc.) of the two or more helical blades 202, thus the present disclosure should not be limited in any way.

Moreover, as set forth above, the leading outer LOS edge 324 may be curved to reduce vibrations and reduce stabilizer damage due to the borehole/blade interaction that would occur if the edge was square. As illustrated, the leading outer LOS edge 324 may be convex with a radius between 0.05-0.75 inches (0.13-1.91 cm). However, the leading outer LOS edge 324 may include any suitable splined surface, chamfer, partially arced surface, or non-straight edged surface for reducing vibration, whirl, or other issues that may be caused by the stabilizer 122 during drilling operations.

Figure 7:
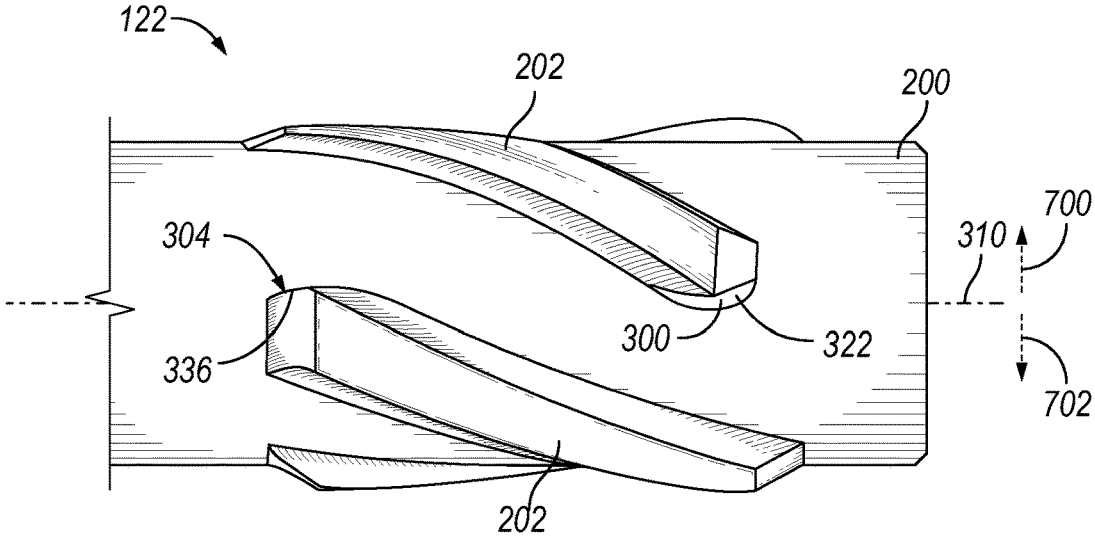
FIG. 7 illustrates a side view of a helical blade stabilizer with longitudinally curved line-of-sight faces, in accordance with some embodiments of the present disclosure.

FIG. 7 illustrates a side view of a helical blade stabilizer 122 with longitudinally curved line-of-sight faces, in accordance with some embodiments of the present disclosure. In particular, the LOS faces 230 may be curved along the longitudinal axis 310 of the downhole tubular 200. In particular the leading inner LOS edge 322 may be curved along the longitudinal axis 310 such that the leading inner LOS edge 322 may wrap about the downhole tubular 200. In the illustrated embodiment, the leading inner LOS edge 322 is curved to wrap about the downhole tubular 200 in a trailing direction 700. Alternatively, the leading inner LOS edge 322 may be curved to wrap about the downhole tubular 200 in a leading direction 702. Similarly, the trailing inner LOS edge 336 is curved to wrap about the downhole tubular 200 in the leading direction 702 but may alternatively be curved to wrap about the downhole tubular 200 in the trailing direction 700. Further, in the illustrated embodiment, the lower LOS face 300 and the upper LOS face 304 are convex. However, in some embodiments, the lower LOS face 300 and the upper LOS face 304 may be concave or some combination thereof. As set forth above, the curved profiles of the lower LOS face 300 and the upper LOS face 304 may configured to reduce stress concentrations on the blade 202 and provide for ease of manufacturability. The radius of the curved profile may be dependent on the blade geometry (gauge size, bypass, etc.) of the two or more helical blades 202, thus the present disclosure should not be limited in any way.

Moreover, the helical blade stabilizers 122 may be manufactured using any suitable manufacturing techniques. For example, additive manufacturing methods to directly generate or print the blades 202 onto the downhole tubular 200. Alternatively, manufacturing techniques such as machining, flow forming, die extrusions, etc. can be used to manufacture the helical blade stabilizer 122. Further, the blade shapes may be prone to erosion so coatings such as those containing hard materials like tungsten carbide may be applied using methods like high velocity oxyacetylene spray, thermal spray, laser cladding, PTA and standard torch welding methods. The exact coating would be dependent on the substrate, blade shape, and available materials/processes.

Although stabilizers have been predominantly mentioned here in this disclosure, the stabilizer features could also be applied to reamers as well. Reamers are used to enlarge bore holes and these features could be used in those applications as well to facilitate debris removal. Similarly, it should be noted that the term stabilizer as used herein is intended to encompass all types of stabilizers and centralizers as might be used in an oil/gas wellbore. Those skilled in the art to which this application relates will appreciate that other and further additions, deletions, substitutions and modifications may be made to the described embodiments.

Accordingly, the present disclosure may provide a helical blade stabilizer having line of sight faces, gauge ramps, and a gauge surfaces configured to reduce pressure losses in the wellbore, as well as reduce vibrations, stick-slip, and whirl during drilling operations. The systems may include any of the various features disclosed herein, including one or more of the following statements.

Statement 1. A stabilizer for use in a wellbore, comprising: a downhole tubular configured to couple to a downhole conveyance in a wellbore; and two or more helical blades extending radially outward from the downhole tubular, wherein the two or more helical blades are oriented about the downhole tubular to form respective flow paths between adjacent blades, and wherein each blade of the two or more helical blades comprises: a line-of-sight face formed adjacent a leading inner blade wall of the blade at a lower end of the blade, wherein the line-of-sight face is angularly offset from the leading inner blade wall; and a gauge ramp extending from an outer surface of the downhole tubular toward an outer blade surface of the blade proximate the lower end of the blade.

Statement 2. The stabilizer of statement 1, wherein the line-of-sight face is oriented at a first helix angle with respect to a longitudinal axis of the downhole tubular, wherein the first helix angle is less than a blade helix angle of the leading inner blade wall such that the line-of-sight face is oriented more angularly downward than the inner blade wall with respect to a longitudinal axis of the downhole tubular.

Statement 3. The stabilizer of statement 1 or statement 2, wherein the first helix angle is between −15 and 15 degrees, and wherein the blade helix angle is greater than 15 degrees.

Statement 4. The stabilizer of any preceding statement, wherein the two or more helical blades are oriented about the downhole tubular to form a wrap angle between 350 degrees to 360 degrees.

Statement 5. The stabilizer of any preceding statement, wherein the two or more helical blades comprises a first blade, a second blade, a third blade, and a fourth blade.

Statement 6. The stabilizer of any preceding statement, wherein the gauge ramp comprises a ramp taper angle between 25 degrees and 35 degrees.

Statement 7. The stabilizer of any preceding statement, wherein a ramp width of the gauge ramp is between 10% to 27% of a blade diameter of the two or more helical blades.

Statement 8. The stabilizer of any preceding statement, further comprising a gauge surface disposed between the gauge ramp and the outer blade surface of the respective helical blade proximate the lower end.

Statement 9. The stabilizer of any preceding statement, wherein the gauge surface comprises a minimum contact length defined as a minimum length of an outer line-of-sight (LOS) edge formed at an interface between the line-of-sight face and the gauge surface, and wherein the minimum contact length is between 0.2 inches to 1.5 inches.

Statement 10. The stabilizer of any preceding statement, wherein the gauge surface comprises a minimum contact width defined as a minimum distance between a line-of-sight (LOS) edge, formed at an interface between the line-of-sight face and the gauge surface, and an opposite edge of the gauge surface, wherein the minimum contact width is between 0.5 inches to 3.0 inches.

Statement 11. The stabilizer of any preceding statement, wherein an outer line-of-sight (LOS) edge, formed at an interface between the line-of-sight face and the gauge surface, comprises a LOS radius between 0.13 inches to 0.38 inches.

Statement 12. The stabilizer of any of statements 1-10, wherein an outer line-of-sight (LOS) edge, formed at an interface between the line-of-sight face and the gauge surface, comprises a 20 degree to 50 degree chamfer.

Statement 13. The stabilizer of any preceding statement, wherein the gauge surface comprises a gauge taper angle between 25 degrees to 35 degrees with respect to the outer blade surface.

Statement 14. The stabilizer of any preceding statement, wherein the respective flow paths each comprise an unobstructed axial flow path between adjacent blades of the two or more helical blades and along longitudinal lengths of the two or more helical blades.

Statement 15. The stabilizer of any preceding statement, wherein the line-of-sight face is planar.

Statement 16. A stabilizer for use in a wellbore, comprising: a downhole tubular configured to couple to a downhole conveyance in a wellbore; and two or more helical blades extending radially outward from the downhole tubular, wherein the two or more helical blades are oriented about the downhole tubular to form respective flow paths between adjacent blades and to form a wrap angle between 350 degrees to 360 degrees, and wherein each blade of the two or more helical blades comprises: a curved line-of-sight face formed adjacent a leading inner blade wall of the blade at a lower end of the blade, wherein the curved line-of-sight face is angularly offset from the leading inner blade wall; and a gauge ramp extending from an outer surface of the downhole tubular toward an outer blade surface of the blade proximate the lower end.

Statement 17. The stabilizer of statement 16, wherein the curved line-of-sight face is curved along a radial direction with respect to the downhole tubular.

Statement 18. The stabilizer of statement 16 or 17, wherein an inner transition radius from the gauge ramp to a surface of the downhole tubular is between 5% to 50% of a blade height of the respective blade.

Statement 19. The stabilizer of any of statements 16-18, wherein an outer transition radius from the gauge ramp to the outer blade surface of the blade proximate the lower end is between 20% to 60% of a blade height of the respective blade.

Statement 20. A stabilizer for use in a wellbore, comprising: a downhole tubular configured to couple to a downhole conveyance in a wellbore; and two or more helical blades extending radially outward from the downhole tubular, wherein the two or more helical blades are oriented about the downhole tubular to form respective flow paths between adjacent blades and to form a wrap angle between 350 degrees to 360 degrees, and wherein each blade of the two or more helical blades comprises: a lower line-of-sight face formed adjacent a leading inner blade wall of the blade at a lower end of the blade, wherein the lower line-of-sight face is angularly offset from the leading inner blade wall; a lower gauge ramp extending from an outer surface of the downhole tubular toward an outer blade surface of the blade proximate the lower end; an upper line-of-sight face formed adjacent a trailing inner blade wall of the blade at an upper end of the blade, wherein the upper line-of-sight face is angularly offset from the trailing inner blade wall; and an upper gauge ramp extending from the outer surface of the downhole tubular toward the outer blade surface of the blade proximate the upper end.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A stabilizer for use in a wellbore, comprising:

a downhole tubular configured to couple to a downhole conveyance in the wellbore; and a plurality of helical blades extending radially outward from the downhole tubular, wherein the plurality of helical blades form a plurality of flow paths between adjacent blades, and wherein each blade of the plurality of helical blades comprises:

a line-of-sight face formed adjacent to a leading inner blade wall of the blade at a lower end of the blade, wherein the line-of-sight face is parallel to a longitudinal axis of the downhole tubular, and wherein the line-of-sight face intersects an outer surface of the downhole tubular at a non-orthogonal angle.

2. The stabilizer of claim 1, wherein the line-of-sight face is oriented at a first helix angle with respect to the longitudinal axis of the downhole tubular, wherein the first helix angle is less than a blade helix angle of the leading inner blade wall such that the line-of-sight face is oriented more angularly downward than the inner blade wall with respect to the longitudinal axis of the downhole tubular.

3. The stabilizer of claim 2, wherein the first helix angle is between −15 and 15 degrees, and wherein the blade helix angle is greater than 15 degrees.

4. The stabilizer of claim 1, wherein the plurality of helical blades are oriented about the downhole tubular to form a wrap angle between 350 degrees to 360 degrees.

5. The stabilizer of claim 1, wherein each blade of the plurality of helical blades further comprises a gauge ramp extending from the outer surface of the downhole tubular toward an outer blade surface of the blade proximate the lower end of the blade.

6. The stabilizer of claim 5, wherein the gauge ramp comprises a ramp taper angle between 25 degrees and 35 degrees.

7. The stabilizer of claim 6, wherein a ramp width of the gauge ramp is between 10% to 27% of a blade diameter of the plurality of helical blades.

8. The stabilizer of claim 5, further comprising a gauge surface disposed between the gauge ramp and the outer blade surface.

9. The stabilizer of claim 8, wherein the gauge surface comprises a minimum contact length defined as a minimum length of an outer line-of-sight (LOS) edge formed at an interface between the line-of-sight face and the gauge surface, and wherein the minimum contact length is between 0.2 inches to 1.5 inches.

10. The stabilizer of claim 8, wherein the gauge surface comprises a minimum contact width defined as a minimum distance between a line-of-sight (LOS) edge, formed at an interface between the line-of-sight face and the gauge surface, and an opposite edge of the gauge surface, wherein the minimum contact width is between 0.5 inches to 3.0 inches.

11. The stabilizer of claim 8, wherein an outer line-of-sight (LOS) edge, formed at an interface between the line-of-sight face and the gauge surface, comprises a LOS radius between 0.13 inches to 0.38 inches.

12. The stabilizer of claim 8, wherein an outer line-of-sight (LOS) edge, formed at an interface between the line-of-sight face and the gauge surface, comprises a 20 degree to 50 degree chamfer.

13. The stabilizer of claim 8, wherein the gauge surface comprises a gauge taper angle between 25 degrees to 35 degrees with respect to the outer blade surface.

14. The stabilizer of claim 1, wherein the plurality of flow paths each comprise an unobstructed axial flow path between adjacent blades of the plurality of helical blades and along longitudinal lengths of the plurality of helical blades.

15. The stabilizer of claim 14, wherein the plurality of flow paths are radially offset from the outer surface of the downhole tubular.

16. A stabilizer for use in a wellbore, comprising:

a downhole tubular configured to couple to a downhole conveyance in the wellbore; and two or more helical blades extending radially outward from the downhole tubular, wherein the two or more helical blades are oriented about the downhole tubular to form respective flow paths between adjacent blades and to form a wrap angle between 350 degrees to 360 degrees, and wherein each blade of the two or more helical blades comprises:

a curved line-of-sight face formed adjacent a leading inner blade wall of the blade at a lower end of the blade, wherein the curved line-of-sight face is parallel to a longitudinal axis of the downhole tubular, and wherein the curved line-of-sight face intersects an outer surface of the downhole tubular at a non-orthogonal angle; and a gauge ramp extending from the outer surface of the downhole tubular toward an outer blade surface of the blade proximate the lower end.

17. The stabilizer of claim 16, wherein the curved line-of-sight face is curved along a radial direction with respect to the downhole tubular.

18. The stabilizer of claim 16, wherein an inner transition radius from the gauge ramp to a surface of the downhole tubular is between 5% to 50% of a blade height of the respective blade.

19. The stabilizer of claim 16, wherein an outer transition radius from the gauge ramp to the outer blade surface of the blade proximate the lower end is between 20% to 60% of a blade height of the respective blade.

20. A stabilizer for use in a wellbore, comprising:

a downhole tubular configured to couple to a downhole conveyance in the wellbore; and two or more helical blades extending radially outward from the downhole tubular, wherein the two or more helical blades are oriented about the downhole tubular to form respective flow paths between adjacent blades and to form a wrap angle between 350-360 degrees, and wherein each blade of the two or more helical blades comprises:

a lower line-of-sight face formed adjacent a leading inner blade wall of the blade at a lower end of the blade, wherein the lower line-of-sight face is parallel to a longitudinal axis of the downhole tubular, and wherein the lower line-of-sight face intersects an outer surface of the downhole tubular at a first non-orthogonal angle;

a lower gauge ramp extending from the outer surface of the downhole tubular toward an outer blade surface of the blade proximate the lower end;

an upper line-of-sight face formed adjacent a trailing inner blade wall of the blade at an upper end of the blade, wherein the upper line-of-sight face is parallel to the longitudinal axis of the downhole tubular, and wherein the upper line-of-sight face intersects the outer surface of the downhole tubular at a second non-orthogonal angle; and an upper gauge ramp extending from the outer surface of the downhole tubular toward the outer blade surface of the blade proximate the upper end.

* * * * *